United States Patent [19]

Graham et al.

[11] Patent Number: 4,773,467

[45] **Date of Patent: * Sep. 27, 1988**

[54] METHOD AND APPARATUS FOR CASTING ARTICLES

[75] Inventors: Lawrence D. Graham, Chagrin Falls; Richard A. Skelley, Minerva; Daniel G. Fetsko, Lyndhurst; Ronald Ardo, Euclid, all of Ohio

[73] Assignee: PCC Airfoils, Inc., Cleveland, Ohio

[ * ] Notice: The portion of the term of this patent subsequent to Jun. 16, 2004 has been disclaimed.

[21] Appl. No.: 22,440

[22] Filed: Mar. 6, 1987

Related U.S. Application Data

[62] Division of Ser. No. 848,398, Mar. 21, 1986, Pat. No. 4,673,021.

[51] Int. Cl.[4] ..... B22D 27/04

[52] U.S. Cl. ..... 164/122.1; 164/136; 164/361; 164/338.1

[58] Field of Search ..... 164/23, 24, 34, 35, 164/36, 122, 122.1, 122.2, 125, 127, 129, 133, 136, 137, 338.1, 339, 350, 352, 353, 361, 507, 513, 516, 517, DIG. 15; 222/591; 219/10.49 R, 10.43, 10.57; 249/111; 264/221

[56] References Cited

U.S. PATENT DOCUMENTS 4,673,021 6/1987 Graham et al. ..... 164/122

*Primary Examiner*—Nicholas P. Godici
*Assistant Examiner*—Richard K. Seidel
*Attorney, Agent, or Firm*—Tarolli, Sundheim & Covell

[57] ABSTRACT

An improved mold includes an upper mold section having a primary distribution system which is connected with a furnace and a lower mold section which is withdrawn from the furnace on a chill plate. A baffle plate is supported from the primary distribution system. The lower mold section includes a secondary distribution system which is connected in fluid communication with the primary distribution system at separable joints. The secondary distribution system is connected in fluid communication with article molds which are disposed in an annular array. During pouring of molten metal, reaction forces are transmitted to the chill plate from the pour cup through a support post and baffle plate. Once the article molds have been filled with molten metal, the chill plate is lowered. The primary distribution system which is connected to the furnace, remains stationary. As the article molds are withdrawn from the furnace, the baffle blocks the transfer of heat from the furnace through the central portion of the array of article molds.

16 Claims, 5 Drawing Sheets

METHOD AND APPARATUS FOR CASTING ARTICLES

This is a divisional of co-pending application Ser. No. 848,398, now U.S. Pat. No. 4,673,021, filed on 3/21/86, which was filed as PCT International Application No. PCT/US86100166 on 1/28/86.

BACKGROUND OF THE INVENTION

The present invention provides a new and improved mold and method of using the mold to cast a plurality of articles.

Heat treatment of single crystal cast articles is facilitated if the articles are solidified with a fine dendritic structure. In an effort to obtain a relatively fine dendritic structure during the casting of the articles, U.S. Pat. Nos. 3,763,926 and 4,108,236 suggest that a large temperature gradient be established as a mold is withdrawn from a furnace. This is done by having the mold immersed in a bath of liquid coolant. To increase the temperature gradient during withdrawal of a mold from a furnace, U.S. Pat. No. 4,108,236 suggests that an insulated baffle be provided between the inside of the furnace and the liquid coolant bath.

The concept of using an annular molten metal distribution system which allows a mold to be completely withdrawn from a furnace past a baffle is disclosed in U.S. Pat. No. 3,810,504. In this patent, an annular array of article molds and the annular molten metal distribution system are supported in the furnace on an annular chill plate. The furnace has a cylindrical outer heater which circumscribes the mold and a cylindrical inner heater which is circumscribed by the mold. During withdrawal of the mold from the furnace, the mold moves downwardly between inner and outer heat sinks. The combination of inner and outer heaters, an annular chill plate, and inner and outer heat sinks results in a relatively complicated apparatus which is difficult to operate and maintain.

SUMMARY OF THE INVENTION

The present invention is directed to a method and apparatus to provide a relatively large temperature gradient between the inside and outside of a furnace as a mold is withdrawn from the furnace. The large temperature gradient is maintained, without a liquid coolant bath, even though article molds are disposed in an annular array having a relatively large diameter. The obtaining of the large temperature gradient is promoted by a baffle which blocks the radiation of heat from a central portion of the annular array of article molds tothe outside of the furnace as the article molds are withdrawn from the furnace. The use of the baffle promotes the formation of horizontal isotherms with a relatively high temperature gradient for each unit length of portions of the article molds as they are withdrawn from the furnace.

The improved apparatus includes a plurality of article molds which are disposed in an annular array having an open central portion. Molten metal is distributed to the article molds through a primary distribution system which is separate from the article molds, a secondary distribution system which is connected with the article molds, and a plurality of separable joints which interconnect the primary and secondary distribution systems. The joints conduct molten metal from the primary distribution system to the secondary distribution system and allow the article molds to be moved away from the primary distribution system after the article molds have been filled with molten metal. The baffle is supported by the primary distribution system and blocks the radiation of heat through the open central portion of the annular array of article molds as they are withdrawn from the furnace.

In order to support the primary distribution system and baffle in the furnace during withdrawal of the annular array of article molds from the furnace, the primary distribution system is connected with the furnace. During pouring of molten metal into a pour cup in the primary distribution system, the article molds are supported on a chill plate. Reaction forces are transmitted from the pour cup to the chill plate through a support post and baffle. During withdrawal of the article molds from the furnace, the post supports the baffle in the central portion of the annular array of article molds.

Accordingly, it is an object of the present invention to provide a new and improved method and apparatus for casting a plurality of articles and wherein a relatively large temperature gradient is maintained between the inside of a furnace and the outside of the furnace during withdrawal of the article molds from the furnace.

Another object of this invention is to provide a new and improved method and apparatus for casting articles wherein a relatively large temperature gradient with horizontal isotherms is established across at least a portion of a mold during withdrawal of the mold from the furnace.

Another object of this invention is to provide a new and improved casting method and apparatus in which a baffle is supported in a furnace by a molten metal distribution system during withdrawal of a mold from the furnace.

Another object of this invention is to provide a new and improved casting method and apparatus in which at least a portion of a system which distributes molten metal to article mold cavities is supported by a furnace during withdrawal of a mold from the furnace.

Another object of this invention is to provide a new and improved method and apparatus for casting a plurality of articles and wherein forces induced during the pouring of molten metal are transmitted through a baffle to a mold support member.

BRIEF DESCRIPTION OF THE DRAWINGS

The foregoing and other objects and features of the present invention will become more apparent upon a consideration of the following description taken in connection with the accompanying drawings wherein.

DESCRIPTION OF SPECIFIC PREFERRED EMBODIMENTS OF THE INVENTION

Mold - General Description

Figure 1:
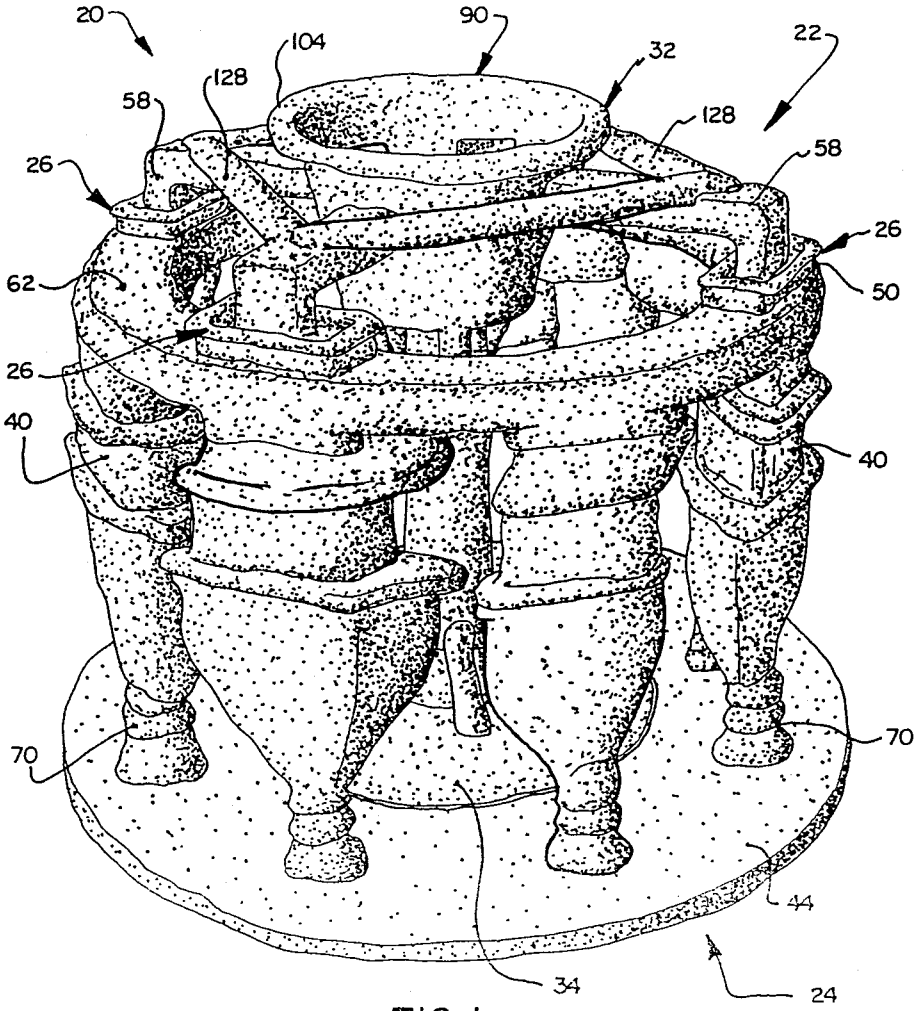
FIG. 1 is a pictorial view of a mold constructed in accordance with the present invention.

An improved ceramic mold 20 constructed in accordance with the present invention is illustrated in FIG. 1. The ceramic mold 20 has an upper section 22 and a lower section 24 which are interconnected at a plurality of separable joints 26. With the exception of a support post plug 28 (FIG. 4), the upper mold section 22 is formed as one piece. The lower mold section 24 is also formed as one piece. The upper and lower mold sections 22 and 24 are made of a known ceramic mold material containing fused silica, zircon and other refractory materials in combination with binders.

Figure 2:
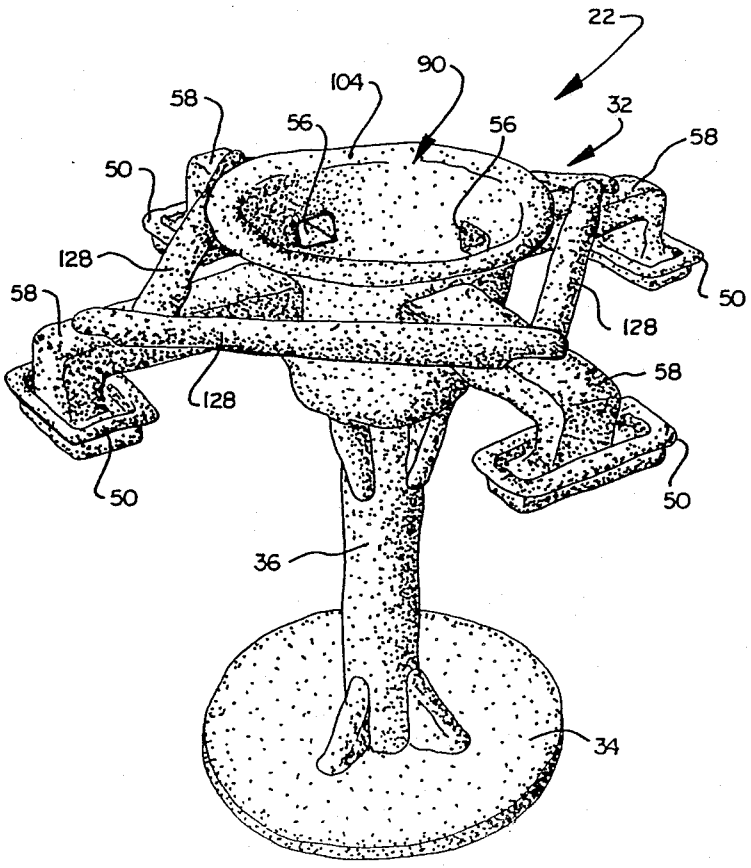
FIG. 2 is a pictorial view of a section of the mold of FIG. 1, illustrating the relationship between a primary molten metal distribution system, baffle plate and support post.

The upper mold section 22 (FIG. 2) includes a ceramic primary molten metal distribution system 32 into which molten metal is poured and then conducted to the lower mold section 24 through the joints 26. A horizontal circular ceramic baffle plate 34 is connected with the primary distribution system 32 by a vertical support post 36. In the illustrated embodiment of the invention, the cylindrical ceramic support post 36 is hollow, having a central passage 38 (FIG. 4) which is blocked by the plug 28. However, if desired, the support post 36 may be formed of a solid body of ceramic material to increase the strength of the post.

The lower mold section 24 (FIG. 3) has a ceramic annular secondary molten metal distribution system 38 which is connected in fluid communication with a plurality of vertically extending article molds 40. The ceramic article molds 40 are disposed in an annular array which is coaxial with the secondary distribution system 38. The annular array of article molds 40 has an open central portion which facilitates heat transfer between radially inwardly facing side surfaces of the article molds 40. In the illustrated embodiment of the lower mold section 24, there are eight article molds 40 disposed in an annular array having an outside diameter of approximately eighteen inches. Of course, a greater or lesser number of article molds 40 could be disposed in either a larger or smaller annular array if desired.

Figure 4:
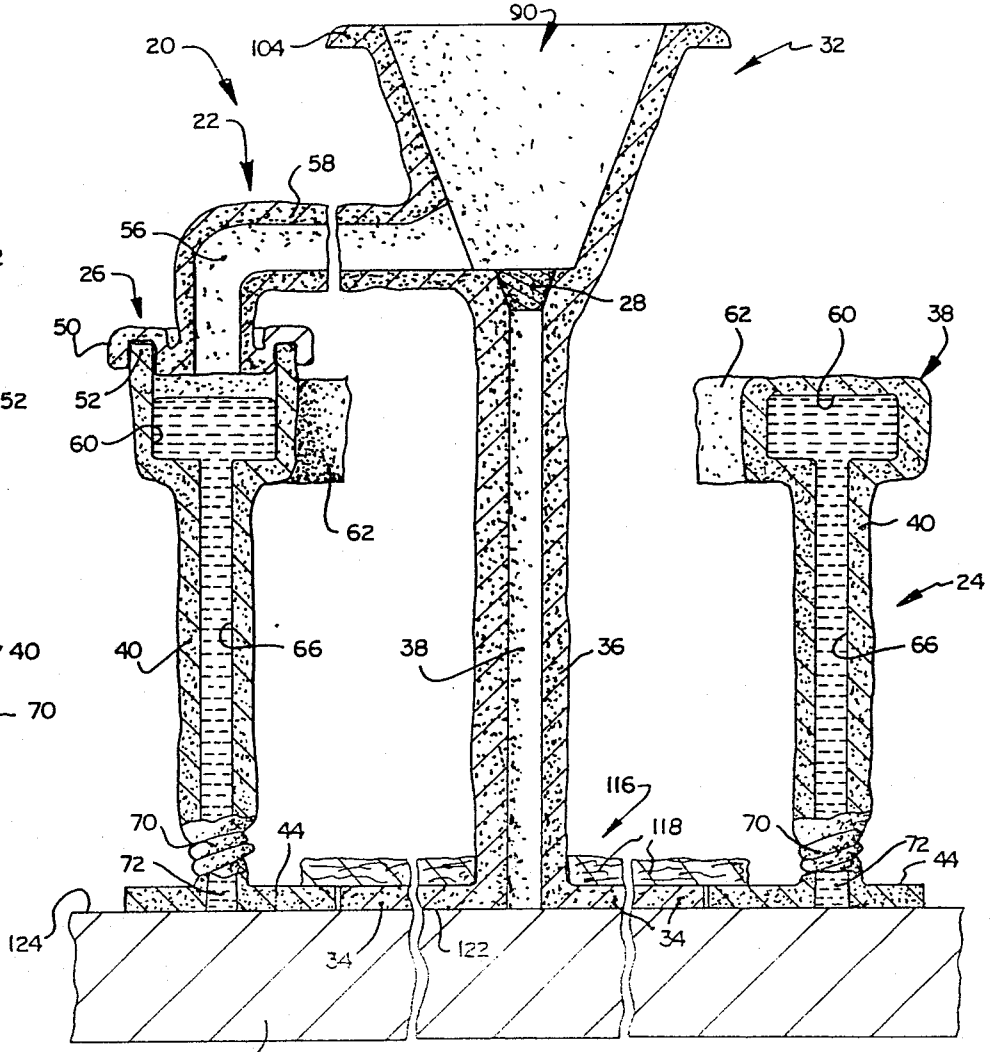
FIG. 4 is a fragmentary sectional view illustrating how the mold section of FIGS. 2 and 3 are interconnected to enable molten metal to flow from the primary distribution system through separable joints to the secondary distribution system and article mold cavities.

An annular ceramic base plate 44 is integrally formed with the lower end portions of the article molds 40 to stabilize the molds and promote sealing engagement with a circular chill plate or support member 46 (FIG. 4). The annular base plate 44 circumscribes the baffle plate 34 when the mold 20 is supported on the chill plate 46. The annular base plate 44, annular array of article molds 40, annular distribution ring 62, circular baffle plate 34 and support post 36 are all disposed in a coaxial relationship (FIG. 1).

The joints 26 (FIGS. 4 and 8) perform the dual functions of conducting molten metal from the primary distribution system 32 to the secondary distribution system 38 and enabling the upper and lower mold sections 22 and 24 to be separated. Each of the identical joints 26 includes an upper section 50 which telescopically and sealingly engages a lower section 52 of the joint. The upper section 50 connects a passage 56 in a radially extending runner 58 with an annular distribution channel 60 in a distribution ring 62 of the secondary distribution system 38 (FIG. 4). The annular distribution channel 60 is connected with cavities 66 disposed in each of the article molds 40. The mold cavities 66 have configurations corresponding to the configurations of the articles to be cast.

It is contemplated that the mold 20 will be used to cast single crystal turbine engine components. Therefore, each of the article mold cavities 66 is connected in fluid communication with helical crystal selector 70 and starter cavity 72 (FIG. 4). The starter cavities 72 are open, at their lower ends, to the chill plate 46.

The one piece ceramic upper and lower mold sections 22 and 24 are formed by repetitively dipping a wax pattern in a slurry of ceramic mold material. The wax pattern may be formed as one piece having a portion with a configuration corresponding to the upper section 22 of the mold 20 and a portion with a configuration corresponding to the configuration of the lower section 24 of the mold. After the wax pattern has been repetitively dipped, it is covered with a layer of ceramic mold material.

The layer of ceramic mold material is partially dried, de-waxed and fired. The resulting mold is then cut at the joints 26 and at a circular junction between the baffle and base plates 34 and 44 to separate the upper and lower mold sections 22 and 24. However, if desired, the mold 20 could be formed by repetitively dipping two separate patterns. Thus, one pattern having a configuration corresponding to the upper section 22 of the mold and a second pattern corresponding to the configuration of the lower section 24 of the mold could be used.

Casting Articles - Preheating Mold

The mold 20 is used to cast a plurality of articles, such as single crystal airfoils for a turbine engine. When a plurality of articles are to be cast, the circular chill plate 46 (FIG. 5) is moved downwardly away from a furnace 78 by operation of a reversible motor 80. Once the chill plate 46 has been lowered, the mold 20 is placed on the chill plate. The motor 80 is then operated to raise the chill plate 46 in the manner indicated by the arrow 82 in FIG. 5.

Figure 5:
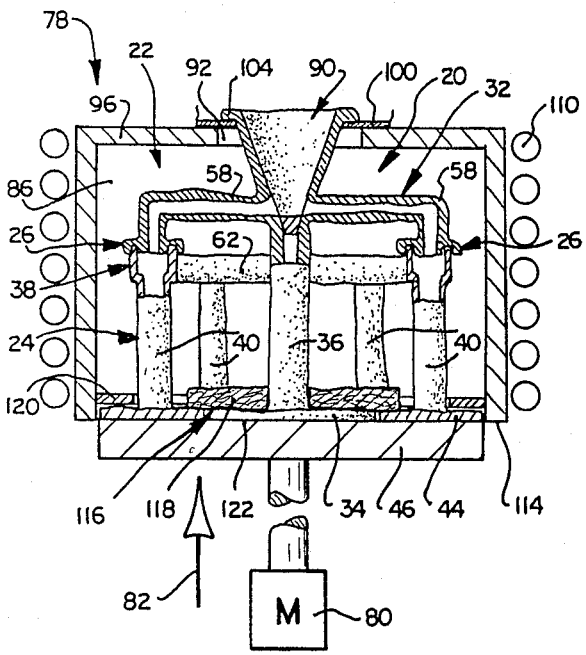
FIG. 5 is schematic illustration depicting the manner in which the mold of FIG. 1 is positioned in a furnace.

As the chill plate 46 moves upwardly toward the furnace 78, the mold 20 enters a cylindrical chamber 86 in the furnace 78. Continued upward movement of the chill plate 46 moves the upper end portion of a molten metal receiving element or pour cup 90 in the primary distribution system 32 through a circular opening 92 formed in the center of a circular upper wall 96 of the furnace 78 (FIG. 5). The pour cup 90 is disposed in a coaxial relationship with the annular array of article molds 40 and the secondary distribution system 38. Although the pour cup 90 has been shown herein as having one particular configuration, it could have other configurations if desired as long as it functions to receive molten metal.

Figure 6:
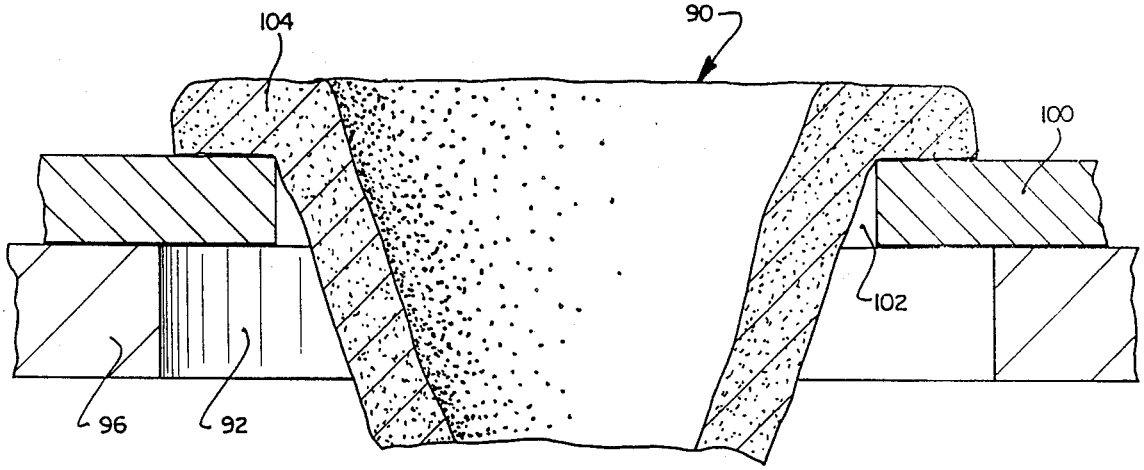
FIG. 6 is an enlarged fragmentary sectional view illustrating the manner in which the mold of FIG. 1 is connected with an upper wall of the furnace of FIG. 5.

Once the mold 20 has been moved into the furnace chamber 86 with the upper end portion of the pour cup 90 extending through the upper wall 96 of the furnace, the upper section 22 of the mold is connected with the furnace. To accomplish this, a plate 100 (FIG. 6) having a generally U-shaped opening 102, is moved between the upper wall 96 of the furnace and an annular rim or lip 104 on the pour cup 90. Although the connector member 100 blocks downward movement of the pour cup 90, the mold 20 is still supported by the chill plate 46 (see FIG. 5). Thus, at this time, the lower surface of the pour cup rim 104 lightly engages or is slightly spaced from the upper surface of the connector member 100. This prevents breakage of the rim 104 of the pour cup 90 during subsequent pouring of molten metal into the pour cup.

Once the mold 20 has been positioned in and connected with the furnace 78, a helical induction heating coil 110 is energized to heat the mold 20 with energy conducted through a generally cylindrical graphite susceptor 114. The entire mold 20 is preheated to a temperature of approximately 2800° F. During preheating of the mold, the copper chill plate 46 is cooled by a flow of a suitable liquid through the chill plate in a known manner. The furnace 78 has the same general construction shown in U.S. Pat. No. 3,841,384.

During preheating, heat loss from the furnace chamber 86 is retarded by a circular baffle 116. The baffle 116 covers a portion of the chill plate 46 to block radiation of heat to the chill plate. The baffle 116 is disposed at the lower end of the support post 38 in a coaxial relationship with the annular array of article molds 40, pour cup 90, and furnace chamber 86. The baffle 116 is formed by the ceramic baffle plate 34 and a body of insulating material 118 disposed on the baffle plate 34 and extending outwardly over the radially inner portion of the base plate 44 (see FIG. 4). The baffle 116 is coaxial with the distribution ring 62 and has an outside diameter which is slightly smaller than the inside diameter of the distribution ring.

The insulating material 118 is a circular plate of graphite having a reflective upper surface. The reflectivity of the upper surface of the insulating material 118 is substantially greater than the reflectivity of the ceramic baffle plate 34. The insulating material 118 could be graphite foil which is commercially available under the trademark "GRAPHFOIL". Other insulating materials could be used if desired.

An annular exterior baffle 120 is fixedly connected to the furnace 78. The baffle 120 blocks the radiation of heat from the furnace chamber 86 along the outside of lower section 24 of the mold 20.

Casting Articles - Pouring Molten Metal

Once the mold 20 has been preheated, molten metal is poured into the pour cup 90 in the primary distribution system 32. The rate of pouring of the molten metal is relatively high. Therefore, substantial forces result from the combined effect of the weight of the molten metal in the pour cup 90 and runners 58 and the impacting of the molten metal against the sides of the pour cup. These forces are transmitted from the bottom of the pour cup 90 to the upper end portion of the support post 36 which is coaxial with the pour cup 90.

The lower end portion of the support post 36 is connected with the baffle plate 34. Therefore, the pouring induced forces are transmitted from the support post 36 to the baffle plate 34. A flat circular bottom surface 122 (see FIG. 4) of the baffle plate 34 is pressed downwardly against the flat circular upper surface 124 of the chill plate 46 to transmit pouring induced forces to the chill plate.

The transmission of the pouring induced forces to the chill plate 46 is substantially independent of the article molds 40. This is because the post 36 supports the primary distribution system 32. The joints 26 are loosely interconnected. Thus, the upper portion 50 (FIG. 4) of each joint 26 rests lightly on or is slightly spaced from the lower portion 52 of the joint. However, the flat bottom surface 122 of the baffle plate 34 abuttingly engages the upper surface 124 of the chill plate 46. Therefore, the forces generated during the pouring of molten metal into the pour cup 90 are transmitted straight downwardly through the post 36 to the baffle plate 34 and chill plate 46.

The ceramic material of the mold 20 is relatively weak in tension and relatively strong in compression. Since the pouring induced forces load the post 36 and baffle plate 34 in compression, there is a minimal tendency for the post and baffle plate to break. If desired, the hollow post 36 could be strengthened by filling the cavity 38 with ceramic material or by providing a ceramic pattern post, rather than a wax pattern post.

If the pouring induced forces were transmitted to the article molds 40 through the runners 58 in the primary distribution system 32, portions of the runners would be stressed in tension with a resulting tendency for the runners to crack or break. Similarly, if the pouring induced forces were transmitted to the upper wall 96 of the furnace through the lip 104 of the pour cup 90, there would be a tendency for the pour cup to crack. By transmitting the forces straight downwardly through the post 36 and baffle plate 34 to the chill plate 46, any tendency for the mold 20 to break is minimized.

The molten metal flows radially outwardly from the pour cup 90 through the passages 56 in the runners 58 to the joints 26. Reinforcing rods 128 have been provided between the runners 58 (FIG. 2) to enable the runners to carry the weight of the molten metal without cracking. The molten metal flows from the runners 58 through the joints 26 to the annular distribution channel 60 in the distribution ring 62 of the secondary distribution system 38. The annular distribution channel 60 is connected in fluid communication with each of the article mold cavities 66 in the article molds 40.

The molten metal flows through the article mold cavities 66 to helical passages in the single crystal selectors 70. The molten metal then flows through the single crystal selectors 70 to the starter cavities 72. The cylindrical starter cavities 72 are open-ended so that the molten metal in the starter cavities is exposed directly to the liquid cooled chill plate 46. The annular base plate 44 stabilizes the lower end portions of the article molds 40 and provides a firm seal with the upper side surface 124 of the chill plate 46.

When the starter cavities 72, single crystal selectors 70, article mold cavities 66, and distribution channel 60 have been filled with molten metal, the pour cup 90 and runner passages 56 are empty (FIG. 4). Therefore, the upper and lower mold sections 22 and 24 can be separated at the joints 26 without spilling any metal.

Casting Articles - Mold Withdrawal

Figure 7:
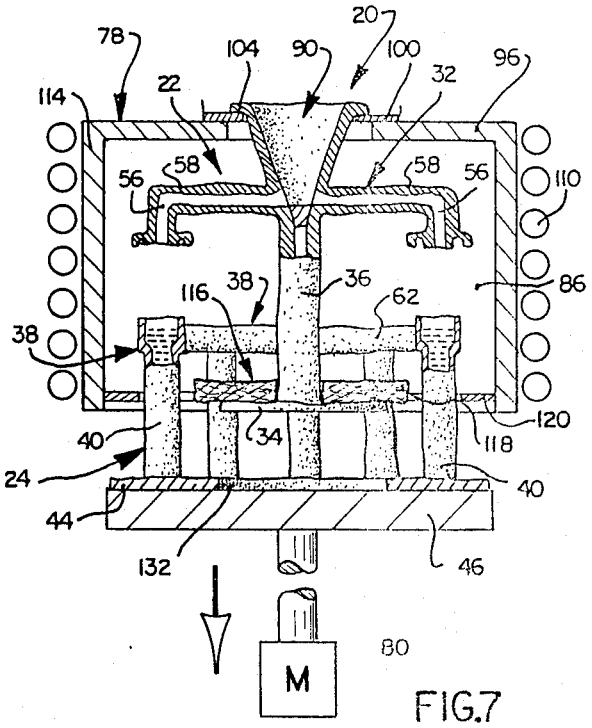
FIG. 7 is a schematic illustration, generally similar to FIG. 5, depicting how a baffle is supported by the primary distribution system as article molds are withdrawn from the furnace.

Once the article molds 40 have been filled with molten metal, the lower section 24 of the mold 20 is separated from the upper section 22 and withdrawn from the furnace 78 in the manner illustrated in FIG. 7. In the illustrated embodiment of the invention, the article molds 40 are withdrawn from the furnace 78 by moving the chill plate 46 downwardly. However, the article molds 40 could be withdrawn from the furnace by moving the furnace upwardly.

As the chill plate 46 is moved downwardly by the motor 80 to withdraw the lower section 24 of the mold from the furnace chamber 86, the upper section 22 of the mold is supported by the upper wall 96 of the furnace 78. Thus, the weight of the upper section 22 of the mold is carried by the rim 104 of the pour cup 90. Since the pour cup 90 and runners 58 are empty, the weight which must be carried by the pour cup and rim 104 is relative small. The post 36 and baffle 116 are supported from the pour cup 90 by the post 36.

As the lower section 24 of the mold is withdrawn from the furnace chamber 86, the molten metal in the starter cavities 72 and helical selectors 70 solidifies. A single crystal of metal grows from each of the helical selectors 70 to the article mold cavities 66. Continued downward movement of the mold 24 results in the single crystals of metal growing through the article mold cavities 66 upwardly to the distribution channel 60. This results in the casting of single crystal articles in the molds 40.

The susceptibility of the single crystal articles to heat treatment is enhanced if the articles are solidified with a fine dendritic structure. In order to obtain a fine dendritic structure during the solidification of the single crystal articles in the mold cavities 66, there should be a relatively large temperature gradient between the portion of the article molds 40 disposed in the furnace cavity 86 above the baffle 116 and portions of the article molds 40 below the baffle. In the past, the obtaining of a large temperature gradient has been attempted by reducing the size of the chill plate 46. Thus, by reducing the diameter of the chill plate from eighteen inches to approximately six inches, a greater temperature gradient may be obtained between the furnace chamber 86 and the outside of the furnace. However, the use of a smaller chill plate is relatively uneconomical since only a few article molds can be positioned on the chill plate.

The mold 20 enables a relatively large temperature gradient to be maintained with a relatively large chill plate. This is because during withdrawal of the lower mold section 24 from the furnace 78, the portions of the article molds 40 above the baffle 116 cannot radiate heat to the portions of the article molds below the baffle. The portions of the article molds 40 above the baffle 116 can radiate heat to each other across the open center of the array of article molds.

As the lower section 24 of the mold 20 is separated from the upper section 22 and withdrawn from the furnace chamber 86, heat from the coil 110 is transmitted, by radiation, directly to the radially outwardly facing side portions of the article molds 40. Due to the open center configuration of the annular array of article molds 40, heat can be readily radiated between the sides of the furnace 78 and the radially inwardly facing sides of the article molds 40. This results in generally horizontal isotherms extending across the lower section 24 of the mold 20.

The use of the baffle 116 to block the radiation of heat through the open center of the annular array of article molds 40 results in a temperature gradient which is approximately twice as great as the temperature gradients obtained with a prior art mold. The increased temperature gradient results in a corresponding reduction in the extent of the mushy zone, that is, the zone between the liquidus and solidus curves. Thus, there is a very high temperature gradient for each unit of length of portions of the article molds 40 disposed immediately above and below the baffle.

The extent of the mushy zone is inversely proportional to temperature gradient. By doubling the temperature gradient, the extent of the mushy zone is reduced by approximately fifty percent. This results in a relatively short dendritic structure which has a minimum of dendrite breakage and spurious nucleation. Although the mold 20 is particularly advantageous for use in the forming of single crystal articles, it should be understood that the mold could be used for forming other directionally solidified articles, such as articles having a columnar grain.

The obtaining of a relatively large temperature gradient between the inside and the outside of the furnace is enhanced by having the chill 46 move away from the ceramic baffle plate 34 as the article molds 40 are withdrawn from the furnace 78. This results in the upper side surface 124 of the chill plate 46 being exposed at a circular opening 132 (FIGS. 3 and 7) formed on the inside of the annular base plate 44. Therefore, heat is radiated from the portions of the article molds 40 beneath the baffle 116 to the relatively cool exposed surface of the chill plate 46 at the opening 132.

The size of the opening 132 can be varied to either increase or decrease the temperature gradient. Thus, the larger the diameter of the opening 132, the greater will be the temperature gradient between the inside and outside of the furnace 78. However, the opening 132 cannot be so large as to impair the ability of the baffle 116 to block the radiation of heat from the inside of the furnace chamber 86 to the chill plate 46. If desired, a layer of foil could be placed over the chill plate 46 at the opening 132 to decrease the temperature gradient.

The ability of the baffle 116 to block the radiation of heat from the furnace chamber 86 is enhanced by having the insulating material 118 extend radially outwardly to a diameter which is only slightly smaller than the inside diameter of the annular distribution ring 62. Since the baffle 116 has a diameter which is slightly smaller than the inside diameter of the distribution ring 62 in the secondary distribution system 38, the lower section 24 of the mold 20 can be completely withdrawn from the furnace chamber 86 by moving the chill plate 46 downwardly. As the lower section 24 of the mold 20 is withdrawn from the furnace 78, a relatively large temperature gradient is established for each unit of length of the portions of the mold assembly 24 which are immediately above and immediately below the baffle 116.

In the embodiment of the invention illustrated in FIGS. 1–8, the upper section 22 of the mold 20 is formed of a material which is capable of only being used during the pouring of molten metal into a single lower section 24 of the mold. Therefore, the upper section 22 of the mold must be removed from the furnace after the lower section 24 of the mold is withdrawn from the furnace. This is accomplished by reversing the operation of the motor 80 to raise the chill plate 46 and lower section 24 of the mold back toward the furnace 78. At this time, the furnace coils 110 are de-energized and the metal in the lower mold section 24 has solidified.

Once the lower mold section 24 has been raised sufficiently to engage the upper mold section 22 at the joints 26 (FIG. 5), the connector member 100 is moved away from the lip 104 of the pour cup 90 to release the upper section of the mold. The upper mold section 22 then rests on the lower section 24 of the mold. The chill plate 46 is then lowered to withdraw the entire mold 20 from the furnace 78.

Once the entire mold 20 has been removed from the furnace, the upper section 22 of the mold is discarded and the cast articles are removed from the lower section 24 of the mold. Although it is preferred to remove the upper section 22 of the mold from the furance by raising the lower section 24 of the mold and chill plate 46, the upper section of the mold could be removed in other ways. For example, the lower secton 24 of the mold could be removed from the chill plate 46 and the upper section 22 merely dropped downwardly into a receptable held above the chill plate to prevent damage to the chill plate.

In the illustrated embodiment of the invention, it is preferred to support the baffle plate 34 and insulation 118 from the pour cup 90 with the post 36. However, the baffle plate 34 and insulation 118 could be supported in other ways. For example, a plurality of ceramic rods could extend between the baffle plate 34 and the runner reinforcing rods 128 (FIG. 2) However, to enable the lower section 24 of the mold to be completely withdrawn from the furnace 78 past the stationary baffle 116, the support for the baffle is independent of support elements extending radially outwardly from the baffle to the vertical sides of the furnace.

The mold 20 has been disclosed herein as having single crystal selectors 70. However, it is contemplated that the mold could be used in conjunction with seed crystals. If this was done, the single crystal selectors 70 would be omitted. Although the mold 20 is particularly advantageous in the casting of single crystal articles, the mold could be used in conjunction with the casting of other articles, such as columnar grained articles.

Distribution Ring - Second Embodiment

In the embodiment of the invention shown in FIGS. 1–8, the annular distribution ring 62 (FIGS. 1 and 3) has a relatively short axial extent compared to its radial extent (FIG. 4). It is believed that the transfer of heat between the furnace and the distribution ring could be improved and the amount of waste metal in the distribution ring minimized by modifying the distribution ring to have the configuration illustrated in FIG. 9. Since the embodiment of the invention shown in FIG. 9 is generally similar to the embodiment of the invention shown in FIGS. 1–8, similar numerals will be utilized to designate similar components, the suffix letter "a" being associated with FIG. 9 to avoid confusion.

Figure 8:
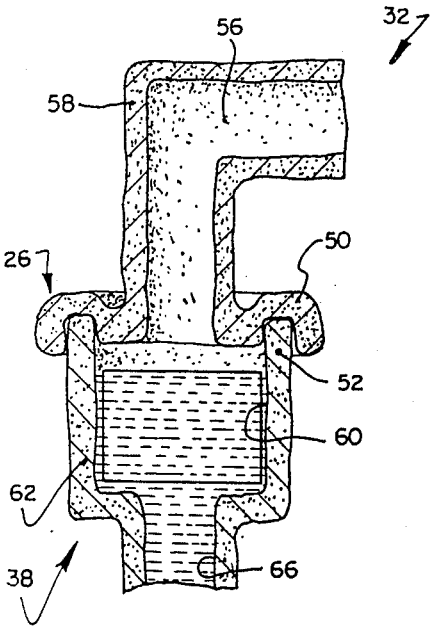
FIG. 8 is an enlarged fragmentary sectional view illustrating the construction of a separable joint which connects the primary distribution system in fluid communication with the secondary distribution system.

The annular distribution ring **62*a* (FIG. 9) defines an annular distribution channel 60*a* which is connected in fluid communication with the article mold cavities 66a in the article molds 40*a*. In addition, the distribution ring 62*a* is connected in fluid communication with the primary distribution system at separable joints in the same manner as shown in FIG. 8**.

Figure 9:
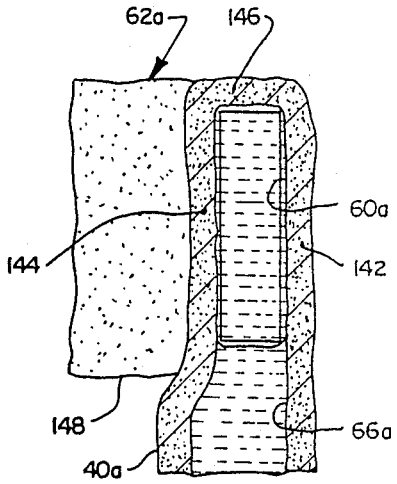
FIG. 9 is a fragmentary sectional view illustrating the construction of another embodiment of the secondary distribution system.

In accordance with a feature of the embodiment of the invention shown in FIG. 9, the distribution ring **62*a* has relatively long axially extending side walls 142 and 144 with relatively short radial side walls 146 and 148. This results in the side surface area of the distribution ring exposed to the heat radiating from the furnace being maximized. However, since the distribution channel 60*a* has a relatively small radial extent or width, the amount of molten metal contained in the distribution ring 60*a* tends to be minimized. Since the molten metal in the distribution channel 60*a* is surplus, that is, this excess metal is cut from the cast articles and discarded, it is desirable to minimize the volume of the distribution channel 60*a***.

Lower Mold Section - Second Embodiment

Figure 3:
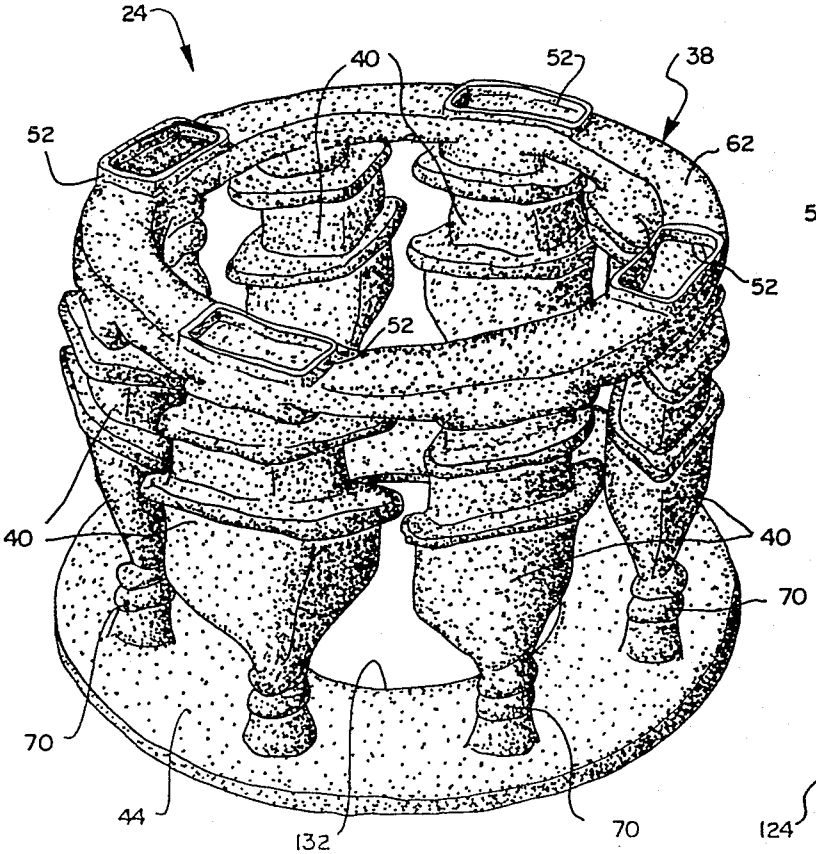
FIG. 3 is a pictorial view of another section of the mold of FIG. 1, illustrating the relationship between a secondary molten metal distribution system, a plurality of article molds and a base plate.
Figure 10:
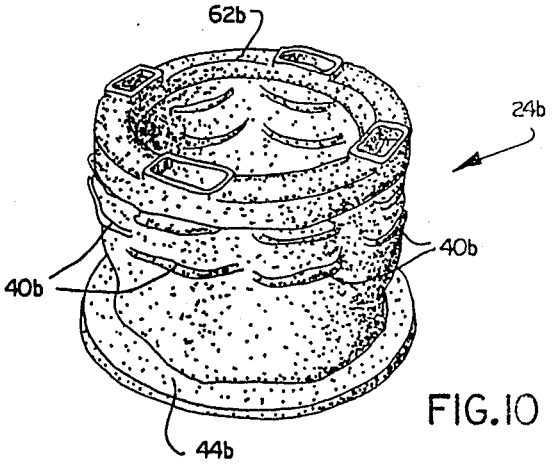
FIG. 10 is a pictorial illustration, generally similar to FIG. 3, illustrating an embodiment of the mold in which the article molds are interconnected to block heat radiation in an axial direction.
Figure 11:
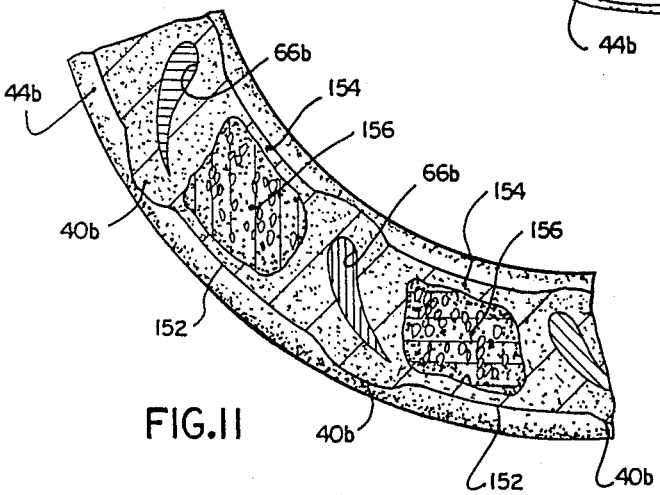
FIG. 11 is a fragmentary sectional view illustrating the construction of a wall of the mold of FIG. 10.

In the embodiment of the invention shown in FIGS. 1–8, the article molds 40 are arranged in an annular array with open spaces between the article molds (see FIGS. 1 and 3). The open space between the article molds 40 allows some heat to be radiated axially downwardly past the baffle 116 as the lower section 24 of the mold is withdrawn from the furnace. In the embodiment of the invention shown in FIG. 10, the open space between the article molds is blocked to prevent the axial transmission of heat between the article molds. Since the embodiment of the invention shown in FIGS. 10 and 11 is generally similar to the embodiment of the invention shown in FIGS. 1–8, similar numerals will be utilized to designate similar components, the suffix letter "b" being associated with the numerals of FIGS. 10 and 11 to avoid confusion.

The lower section **24*b* of a mold has a plurality of article molds, indicated generally at 40*b*, with mold cavities 66*b* (FIG. 11) which are interconnected by wall or blocking sections 152. The wall or blocking sections 152 are formed by a layer 154 of ceramic mold material over the bodies 156 of ceramic foam. The blocking sections 152 interconnect the article molds 40 to form a solid annular mold wall (see FIG. 10). The solid annular mold wall blocks the axially downward radiation of heat between the article molds 40*b***.

The wall of the lower mold section 24b extends both inwardly and outwardly of the distribution ring **62*b*. Thus, the annular mold wall has an inside diameter which is less than the inside diameter of the distribution ring 62*b*. Similarly, the annular mold wall has an outside diameter which is greater than the outside diameter of the distribution ring 62*b***.

When the lower mold section **24*b* is withdrawn from a furnace, in a manner similar to that indicated schematically in FIG. 7, heat cannot be radiated downwardly through axial extending spaces between an annular distribution ring 62*b* and an annular base plate 44*b*. To form the lower section 24*b* of the mold with a solid wall, the ceramic foam 156 is mounted between wax patterns which form the article mold cavities 66*b*. When the mold pattern is repetitively dipped in a slurry of ceramic mold material, layers 154 of ceramic mold material build up around the ceramic foam 156 to form the lower mold section 24*b*** with a continuous annular wall.

Pour Cup - Second Embodiment

Figure 12:
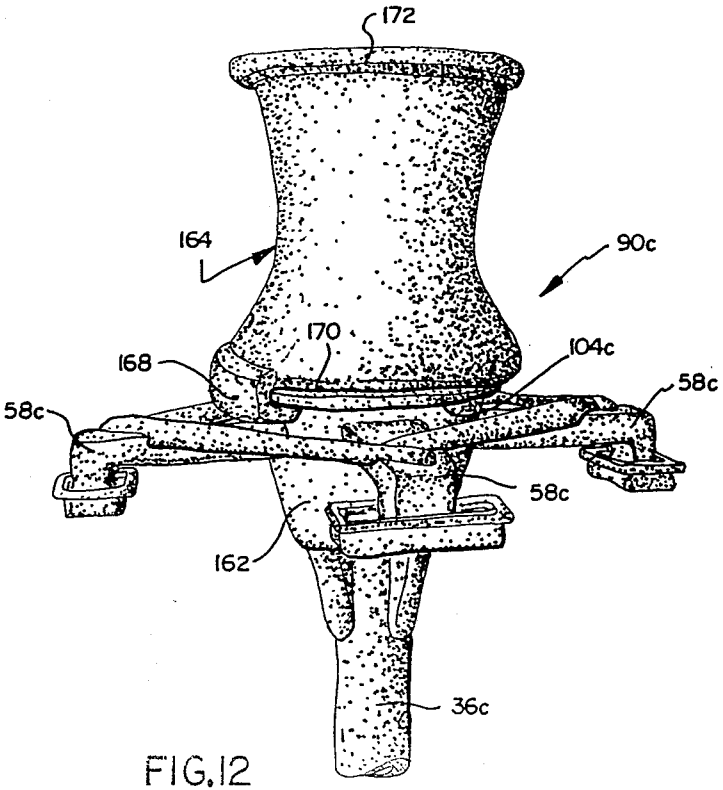
FIG. 12 is a pictorial view illustrating an embodiment of the mold in which a pour cup in the primary distribution system has a base section and an extension section.

It is desirable to provide a relatively large vertical space between the open central portion of the annular array of article molds 44 and the upper wall 96 of the furnace 78 (see FIG. 5). Although this could be done by increasing the vertical extent of the runners 58 and support post 36, it may be preferred to increase the vertical extent of the pour cup 90. In the embodiment of the invention shown in FIG. 12, the vertical extent of the pour cup has been increased to increase the distance between the upper wall 96 of the furnace and the open central section of the annular array of article molds. Since the embodiment of the invention shown in FIG. 12 is generally similar to the embodiment of the invention shown in FIGS. 1–8, similar numerals will be utilized to designate similar components, the suffix letter "c" being associated with the numerals of FIG. 12 in order to avoid confusion.

A pour cup 90c includes a base section 162 having the same general configuration as the pour cup 90 of FIG. 4, and a hollow extension section 164. The extension section 164 has a generally circular configuration throughout its axial extent with a lower lip 168 extending inwardly from a lower end portion of the extension. The lip 68 extends half way around the lower edge portion 170 of the extension 164. The lip 168 engages the rim 104c on the base section 162 of the pour cup 90c to interconnect the base section 162 and extension 164.

The hollow extension section 164 curves inwardly from the lower edge 170 and then flares outwardly to an upper rim 172. The upper rim 172 of the pour cup extension 164 is engaged by a connector member to connect the pour cup 90c with the upper wall of a furnace in much the same manner as in which the connector member engages the rim 104 on the pour cup 90 of FIG. 6. The use of the hollow extension 164 results in the runners 58c being positioned further from the upper wall of the furnace to facilitate the radiating of heat to the inwardly facing side surfaces of article molds.

Upper Mold Section - Second Embodiment

In the embodiment of the invention illustrated in FIGS. 1–8, the upper section 22 of the mold is used for a single casting operation and then discarded. However, if the upper section of the mold was formed of a relatively durable material, it could be reused. This would eliminate the necessity of forming an upper section 22 for each of the molds and would eliminate the necessity of removing an upper mold section from the furnace each time a mold is cast.

Figure 13:
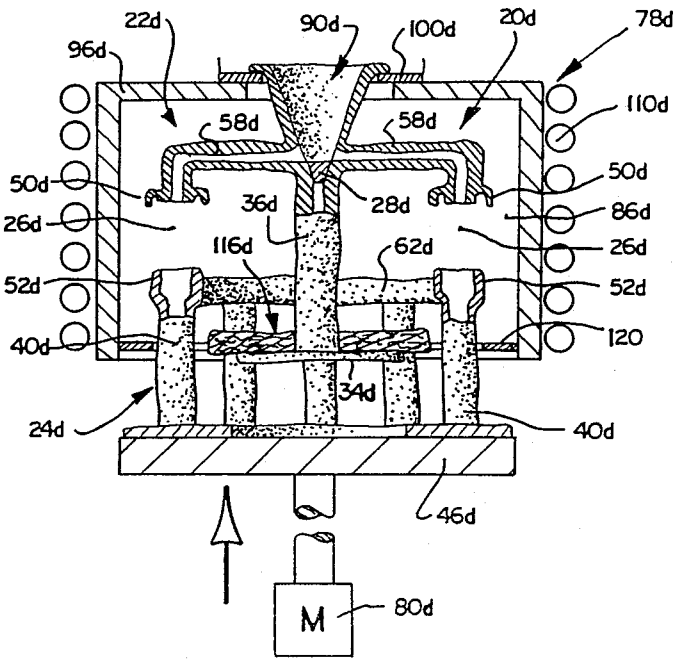
FIG. 13 is a schematic illustration, generally similar to FIG. 5, depicting a furnace having a reusable primary distribution system and baffle.

In the embodiment of the invention shown in FIG. 13, the mold has a reusable upper mold section. Since the embodiment of the invention shown in FIG. 13 is generally similar to the embodiment of the invention shown in FIGS. 1–8, similar numerals will be utilized to designate similar components, the suffix letter "d" being associated with the embodiment of the invention shown in FIG. 13 to avoid confusion.

A mold 20d has a reusable upper section 22d and a nonreusable lower section 24d. The upper section 22d of the mold is formed of alumina and can withstand repeated exposures to hot molten metal without deterioration. The configuration of the upper mold section 22d is the same as the configuration of the upper section 22 of the mold 20.

The reusable mold section 22d is formed as one piece, with the exception of a plug 28d, of alumina. The upper mold section 22d has a pour cup 90d which is connected with runners 58d. A support post 36d extends downwardly from the lower end portion of the pour cup 90d to a baffle plate 34d. A connector member 100d cooperates with the pour cup 90d to connect the upper mold section 22d with the upper wall 96d of the furnace 78d. Since the upper section 22d of the mold is reusable, it does not have to be released each time molten metal is poured into a non-reusable lower section 24d.

The non-reusable lower section 24d includes a distribution ring 62d which is connected in fluid communication with a pluralitiy of article molds 40d. The lower mold section 24d is supported on a chill plate 46d. During pouring of the molten metal into the pour cup 90d, the baffle plate 34d rests on the upper side surface of the chill plate 46d. This enables forces generated by the pouring of the molten metal to be transmitted directly through the post 36d and baffle plate 34d to the chill plate 46d.

When a plurality of articles are to be cast in a lower section 24d of a mold, the lower section 24d is raised hupwardly into the furnace chamber 86d. Upwardly extending joint sections 52d on the lower mold section 24d are aligned with upper joint sections 50d. Therefore, the joints 26d between the upper and lower sections are closed as the lower mold section 24d moves into the furnace chamber 86d. The upward movement of the lower section 24d is stopped when the joints 26d have been closed and the weight of the upper portion 22d has been transmitted through the support post 36d and baffle plate 34d to the chill plate 46d.

After molten metal has been poured into the pour cup 90d, the chill plate 46d is retracted to withdraw the lower mold section 24d from the furnace chamber 86d. As the lower secton 24d of the mold is withdrawn from the furnace 78d, the baffle 116d blocks the radiation of heat from the inside of the furnace to the outside of the furnace. Therefore, a relatively large temperature gradient is established between portions of the article molds 40d disposed above the baffle 116d and the portions of the article molds 40d disposed below the baffle.

Once the upper mold section 24d has been lowered from the furnace chamber, it can be removed from the chill plate 46d. The cast articles are then removed from the mold 24d. Of course, during the removal of the cast articles from the lower mold section 24d, the lower mold section is destroyed.

Additional articles may be cast by providing another lower mold section 24d . The second lower mold section 24d is placed on the chill plate 46d and raised into the furnace 78d to engage the reusable upper mold section 22d. A next succeeding group of articles is then cast by pouring molten metal into the pour cup 90d, conducting a flow of metal to the article molds in the second lower mold section. Additional lower mold sections 24d are subsequently raised into the furnace 78d, filled with molten metal conducted from the reusable upper mold section 22d and then withdrawn from the furnace. Of course, if the upper mold section 22d deteriorates over a period of time, it will be replaced.

Conclusion

In view of the foregoing description, it is apparent that the present invention is directed to a method and apparatus which provides a relatively large temperature gradient between the inside and outside of the furnace 78 as the mold 20 is withdrawn from the furnace. This relatively large temperature gradient is maintained even though the article molds 40 are disposed in a large diameter annular array. The obtaining of the large temperature gradient is promoted by having a baffle 116 which blocks the radiation of heat from a central portion of the annular array of article molds 40 to the outside of the furnace 78 as the article molds are withdrawn from the furnace. The use of the baffle 116 promotes the formation of horizontal isotherms with a relatively high temperature gradient for each unit of length of portions of the article molds 40 as they are withdrawn from the furnace 78.

The improved apparatus includes a plurality of article molds 40 which are disposed in an annular array having an open central portion. Molten metal is distributed to the article molds 40 through a primary distribution system 32 which is separate from the article molds, a secondary distribution system 38 which is connected with the article molds, and a plurality of separable joints 26 which interconnect the primary and secondary distribution systems. The joints 26 conduct molten metal from the primary distribution system 32 to the secondary distribution system 38 and allow the article molds 40 to be moved away from the primary distribution system after they have been filled with molten metal. The baffle 116 is supported by the primary distribution system 32 and blocks the radiation of heat through the open central portion of the annular array of article molds 40 as they are withdrawn from the furnace 78.

In order to support the primary distribution system 32 and baffle 116 in the furnace during withdrawal of the annular array of article molds from the furnace, the primary distribution system 32 is connected with an upper wall 96 of the furnace. During pouring of molten metal into the pour cup 90 in the primary distribution system 32, reaction forces are transmitted from the pour cup to a chill plate 34 through a support post 36. During withdrawal of the article molds 40 from the furnace 78, the post 36 supports the baffle 34 plate in the central portion of the array of article molds.

Having described specific preferred embodiments of the invention, the following is claimed:

1. Apparatus for casting metal, said apparatus comprising furnace means for heating molds, said furnace means having a furnace chamber and a bottom opening, a mold including a plurality of article molds arranged in an array having an open central portion and molten metal distribution means for filling said article molds with molten metal, means for moving said mold in and out of said furnace chamber through said bottom opening, insulating baffle means disposed in said central portion of said array of article molds adjacent said bottom opening when said mold is positioned in said furnace chamber and substantially blocking said central portion against transfer of heat therethrough, means for supporting said baffle means independently of said array of article molds during removal of said array of article molds from said furnace chamber through said bottom opening so that said array of article molds moves past said baffle means, and said baffle means being removable from adjacent said bottom opening substantially simultaneously with removal of said molten metal distribution means from said furnace chamber.

2. A method of casting molten metal comprising the steps of providing a mold including a plurality of article molds arranged in an array having an open central portion and molten metal distribution means for filling said article molds with molten metal, positioning said mold in a furnace chamber having a bottom opening, substantially blocking said central portion of said array of article molds against transfer of heat therethrough with baffle means located in said central portion adjacent said furnace bottom opening, filling said article molds with molten metal through said molten metal distribution means, removing said array of article molds from said furnace chamber through said bottom opening while supporting said baffle means against movement so that said array of article molds moves therepast, and removing said molten metal distribution means from said chamber and said baffle means from adjacent said bottom opening.

3. A furnace having a chamber for receiving an array of article molds having an open central portion, said chamber having top, bottom and side portions, central baffle means adjacent said furnace bottom and occupying substantially the entire area of the open central portion for blocking heat transmission therethrough when the array of article molds is positioned in said chamber, a continous annular opening surrounding said baffle means and through which the array of article molds is removable from said chamber, said baffle means substantially closing said bottom portion of said chamber inwardly of said annular opening, and structural support means independently of the array of article molds for supporting said baffle means against movement as the array of article molds moves therepast through said annular opening.

4. The furnace as set forth in claim 3 wherein said baffle means is selectively removable from adjacent said furnace bottom portion subsequent to removal of the array of article molds from said chamber for substantially completely opening said furnace bottom portion to facilitate insertion of a new mold assembly into said furnace chamber.

5. The furnace as set forth in claim 3 wherein said support means extends upwardly from said baffle means toward said chamber top portion.

6. A method of casting metal comprising the steps of providing a furnace having a furnace chamber and a bottom opening, providing a plurality of article molds disposed in an array having an open central portion, providing baffle means independent of said array of article molds for location adjacent said furnace bottom opening in said central portion of said array of article molds when said array of article molds is positioned in said chamber for substantially blocking the entire area of said central portion against transmission of heat therethrough from said furnace chamber to the exterior thereof, positioning said array of article molds in said furnace chamber, filling said article molds with molten metal in said furnace chamber, moving said array of article molds out of said furnace chamber through said bottom opening past said baffle means, structurally supporting said baffle means independently of said array of article molds while said array of article molds is positioned in said chamber and during removal of said array of article molds from said chamber, and using said baffle means for inhibiting transfer of heat from within said furnace chamber to the opposite side of said baffle means through said central portion of said array of article molds while said array of article molds is in said chamber and during removal thereof from said chamber.

7. A method as set forth in claim 6 including the step of removing said baffle means from adjacent said furnace bottom opening subsequent to removal of said array of article molds from said chamber to substantially completely open said furnace bottom opening to facilitate insertion of a new mold assembly into said chamber.

8. Apparatus for casting a plurality of articles comprising a plurality of article molds disposed in an array having an open central portion, a primary distribution system which is separate from said article molds, means for conducting a flow of molten metal from said primary distribution system to said article molds to fill same with molten metal, means for separating said article molds and primary distribution system by providing relative movement between said article molds and primary distribution system, baffle means disposed in said central portion of said array of article molds and occupying substantially the entire area of said central portion for retarding the transmission of heat therethrough from said article molds, and structural support means for supporting said baffle means independently of said article molds during relative movement between said article molds and primary distribution system.

9. Apparatus for casting a plurality of articles comprising a mold having a plurality of article molds disposed in an array having an open central portion, a primary distribution system positionable in fluid communication with said article molds, substantially stationary baffle means separate from said mold and being disposed in and occupying substantially the entire area of said central portion for blocking transmission of heat therethrough, a furnace having a furnace chamber, means for moving said mold into and out of said furnace chamber past said baffle means and into and out of cooperative relationship with said primary distribution system, whereby said baffle means retards radiation of heat from the furnace chamber through the central portion of said array of article molds and said array of article molds is readily separable from said primary distribution system after being filled with molten metal.

10. Apparatus for casting a plurality of articles comprising a plurality of article molds disposed in an array having an open central portion, said article molds having upper end portions connected together by an annular distribution channel through which molten metal is supplied to said article molds, and said distribution channel being upwardly open for direct reception of molten metal therein at a plurality of circumferentially-spaced locations, whereby said array of article molds is positionable in cooperate relationship with a primary distribution system through which molten metal is flowable to said plurality of circumferentially-spaced locations in said annular distribution channel.

11. The apparatus as set forth in claim 10 wherein said annular distribution channel is upwardly open at a plurality of circumferentially-spaced openings and is upwardly closed between said openings.

12. The apparatus as set forth in claim 10 wherein said annular distribution channel has a cross-sectional height which is substantially greater than its cross-sectional width.

13. Apparatus for casting molten metal comprising a primary distribution system through which molten metal is supplied to a plurality of spaced-apart locations, a plurality of article molds arranged in an array and including means for receiving molten metal, separable joint means between said primary distribution system and said means for receiving molten metal and through which molten metal flows from said primary distribution system to said means for receiving molten metal, whereby said array of article molds is movable toward said primary distribution system to establish said joint means for filling said article molds with molten metal and said array of article molds is then readily movable away from said primary distribution system by virtue of said separable joint means.

14. The apparatus as set forth in claim 13 wherein said primary distribution system is positioned above said array of article molds and includes a plurality of runners extending outwardly from a central cup, said joint means providing physical engagement between said runners and said means for receiving molten metal for providing vertical support for said runners on said array of article molds when molten metal is supplied through said primary distribution systems to said article molds.

15. A molten metal distribution system for filling a plurality of article molds with metal comprising a central pour cup having a plurality of runners extending outwardly therefrom, a baffle plate spaced substantially below said cup and runners, elongated support means connecting said cup and baffle plate, the space between said runners and said baffle plate and between said cup and said baffle plate being completely unoccupied except for said elongated support means, and said runners having downwardly open end portions for cooperation with article molds separably positionable in cooperative relationship with said open end portions in the space between said runners and said baffle plate.

16. The distribution system as set forth in claim 15 including a furnace having a furnace chamber in which said distribution system is located, and means for supporting said distribution system from above on said furnace.

* * * * *